US011225901B2

(12) United States Patent
Komatsu et al.

(10) Patent No.: US 11,225,901 B2
(45) Date of Patent: Jan. 18, 2022

(54) EXPANSION TANK

(71) Applicant: HONDA MOTOR CO., LTD., Tokyo (JP)

(72) Inventors: Shuji Komatsu, Saitama (JP); Naoki Hotta, Saitama (JP); Keijiro Koide, Saitama (JP); Shinji Shimoyama, Saitama (JP); Ichiro Fukuzawa, Saitama (JP); Yusuke Fukada, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/212,177

(22) Filed: Mar. 25, 2021

(65) Prior Publication Data

US 2021/0301713 A1 Sep. 30, 2021

(30) Foreign Application Priority Data

Mar. 30, 2020 (JP) ..... JP2020-059905

(51) Int. Cl.
*F01P 11/02* (2006.01)

(52) U.S. Cl.
CPC ..... *F01P 11/029* (2013.01); *F01P 11/02* (2013.01)

(58) Field of Classification Search
CPC ..... F01P 11/029; F01P 11/02
See application file for complete search history.

(56) References Cited

U.S. PATENT DOCUMENTS 5,680,833 A * 10/1997 Smith ..... F01P 11/029 123/41.54
2018/0283261 A1* 10/2018 Morishita ..... F01P 11/029

FOREIGN PATENT DOCUMENTS

| | | | |
|---|---|---|---|
| JP | H05209522 | A | 8/1993 |
| JP | 2013072359 | A | 4/2013 |
| JP | 2017078399 | A | 4/2017 |
| JP | 6461364 | B2 | 1/2019 |
| JP | 2019060275 | A | 4/2019 |

OTHER PUBLICATIONS

Office Action for Patent Application JP 2020-059905 dated Jul. 27, 2021; 3 pp.

* cited by examiner

*Primary Examiner* — Jacob M Amick
(74) *Attorney, Agent, or Firm* — Armstrong Teasdale LLP

(57) ABSTRACT

An expansion tank, includes: a tank main body defining a storage chamber storing a coolant liquid therein; multiple partition walls provided in the tank main body to divide the storage chamber into multiple division chambers including an inlet chamber and an outlet chamber, the partition walls being formed with communication holes for bringing adjacent ones of the division chambers into communication with each other; a coolant liquid inlet portion that is provided on the tank main body and is open to the inlet chamber; a coolant liquid outlet portion that has an outlet opening in a depression formed in a bottom of the tank main body and is open to the outlet chamber; and a barrier wall extending from a side wall of the tank main body or one of the partition walls into the depression.

8 Claims, 4 Drawing Sheets

EXPANSION TANK

TECHNICAL FIELD

The present invention relates to an expansion tank, and more specifically to an expansion tank used in a cooling system of an internal combustion engine.

BACKGROUND ART

An expansion tank used in a cooling system of an internal combustion engine is connected to a coolant liquid circulation passage including a radiator or the like, and is configured to absorb the volume fluctuation of the coolant liquid owing to temperature changes by admitting and expelling the coolant liquid into and out of the expansion tank as required. A known expansion tank of this kind includes a tank main body defining a storage chamber for storing the coolant liquid therein, multiple partition walls provided in the tank main body to divide the storage chamber into multiple division chambers including an inlet chamber and an outlet chamber, the partition walls being formed with communication holes for bringing adjacent ones of the division chambers into communication with each other, a coolant liquid inlet provided in the tank main body to be open to the inlet chamber, and a coolant liquid outlet provided in the tank main body to be open to the outlet chamber (for example, JP6461364B2).

In such an expansion tank, when the coolant liquid flows out from the coolant liquid outlet to the coolant liquid circulation passage, a vortex flow of the coolant liquid called a bathtub vortex tends to be generated above the coolant liquid outlet. The vortex flow is generated substantially about the coolant liquid outlet and causes a part of the liquid surface above the coolant liquid outlet to be depressed in an approximately conical shape, and therefore, when the liquid level in the storage chamber is low, air may get entrained in the coolant liquid so that many air bubbles may flow into the coolant liquid circulation passage.

To address this issue, JP2019-60275A discloses a reserve tank having a rib wall provided in a tank main body such that the flow of coolant liquid collides with the rib wall. This reduces the flow speed of the coolant liquid and thereby suppresses entrainment of air into the coolant liquid flowing from the storage chamber to the coolant liquid outlet. Also, JP2017-78399A discloses an expansion tank internally provided with a tubular portion at a position above the coolant liquid outlet, where the tubular portion has a lower end open toward the coolant liquid outlet such that reduction of the internal pressure in the tubular portion suppresses generation of the vortex flow of the coolant liquid at the coolant liquid outlet.

However, in the conventional reserve tank or expansion tank, it is difficult to sufficiently suppress the vortex flow of the coolant liquid generated above the coolant liquid outlet, and there is a limit to suppressing the inflow of bubbles into the coolant liquid circulation passage.

SUMMARY OF THE INVENTION

An object of the present invention is to provide an expansion tank which can effectively suppress generation of the vortex flow of the coolant liquid in the vicinity of the coolant liquid outlet, thereby to effectively suppress inflow of air bubbles into the coolant liquid circulation passage.

One embodiment of the present invention provides an expansion tank (10), comprising: a tank main body (18) defining a storage chamber (16) storing a coolant liquid therein; multiple partition walls (40, 42, 44, 46, 48, 50, 52) provided in the tank main body to divide the storage chamber into multiple division chambers (38) including an inlet chamber (34) and an outlet chamber (36), the partition walls being formed with communication holes (54) for bringing adjacent ones of the division chambers into communication with each other; a coolant liquid inlet portion (28) that is provided on the tank main body and is open to the inlet chamber; a coolant liquid outlet portion (60) that has an outlet opening (62) in a depression (56) formed in a bottom of the tank main body and is open to the outlet chamber; and a barrier wall (66) extending from a side wall (32) of the tank main body or one of the partition walls into the depression.

According to this configuration, the barrier wall suppresses generation of the vortex flow of the coolant liquid in the vicinity of the coolant liquid outlet.

In the above the expansion tank, preferably, the barrier wall extends in a direction crossing the outlet opening.

According to this configuration, the barrier wall effectively suppresses generation of the vortex flow of the coolant liquid in the vicinity of the coolant liquid outlet.

In the above the expansion tank, preferably, the outlet chamber is in communication with at least two division chambers adjacent thereto via the communication holes formed in the partition walls separating the at least two division chambers from the outlet chamber, and the communication holes that are open to the outlet chamber include those positioned on either side of the barrier wall.

According to this configuration, generation of the vortex flow of the coolant liquid in the vicinity of the coolant liquid outlet is suppressed owing to at least two flows of the coolant liquid flowing into the outlet chamber through the communication holes.

In the above the expansion tank, preferably, the barrier wall extends to at least a height substantially corresponding to a lowest liquid level of the coolant liquid stored in the storage chamber.

According to this configuration, the barrier wall can demonstrate the effect of suppressing the vortex flow of the coolant liquid even if the liquid level of the coolant liquid stored in the storage chamber becomes the lowest liquid level.

In the above the expansion tank, preferably, the depression is defined by a portion (56B) of a bottom wall of the tank main body slanting downward toward a central part (56A) of the depression, and the coolant liquid outlet portion includes a coolant liquid outlet tube (64) extending out from the outlet opening to outside of the tank main body along a slant direction of the portion of the bottom wall.

According to this configuration, the coolant liquid flowing out of the tank from the depression through the coolant liquid outlet portion can flow smoothly.

The expansion tank according to an embodiment of the present invention can effectively suppress generation of the vortex flow of the coolant liquid in the vicinity of the coolant liquid outlet is effectively suppressed, thereby to effectively suppress inflow of air bubbles into the coolant liquid circulation passage.

DESCRIPTION OF THE PREFERRED EMBODIMENT(S)

In the following, one embodiment of an expansion tank according to the present invention will be described with reference to FIGS. 1 to 4.

Figure 1:
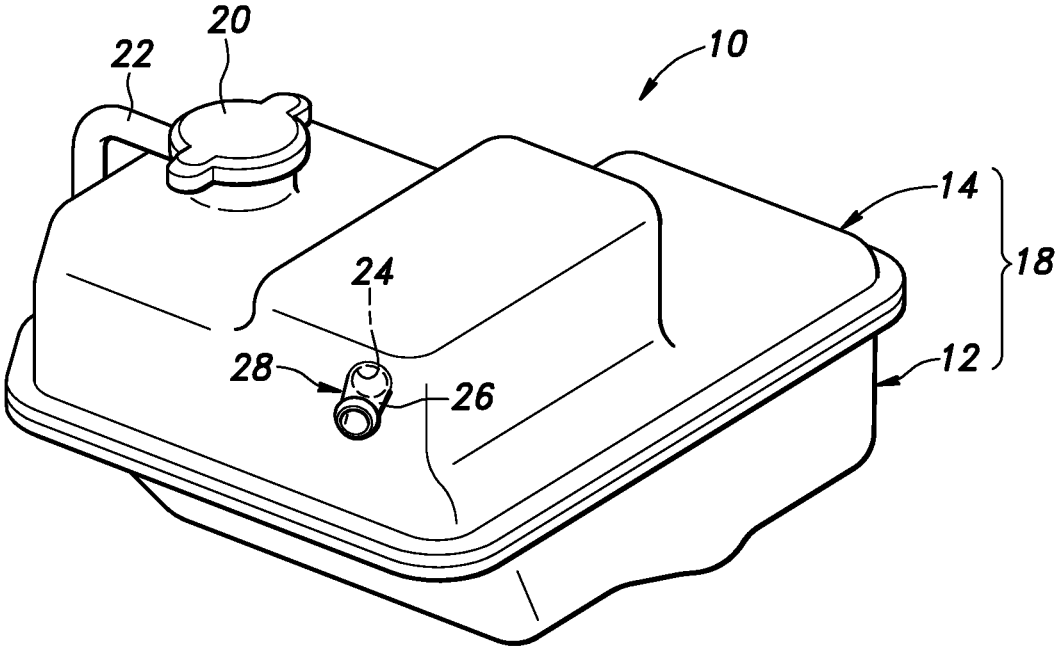
FIG. 1 is a perspective view showing one embodiment of an expansion tank according to the present invention.

As shown in FIG. 1, an expansion tank 10 of the present embodiment includes a tank main body 18 constituted of a lower tank member 12 and an upper tank member 14 that are airtightly joined to each other and are each made of resin. The tank main body 18 defines a storage chamber 16 (see FIG. 2) storing a coolant liquid therein. On the upper tank member 14, a lid cap 20 equipped with a relief valve and an air vent tube 22 is mounted.

The upper tank member 14 is provided with a coolant liquid inlet portion 28 including an inlet opening 24 that is open to a later-described inlet chamber 34 and a coolant liquid inlet tube 26 communicating with the inlet opening 24 and extending to outside of the tank main body 18.

Figure 2:
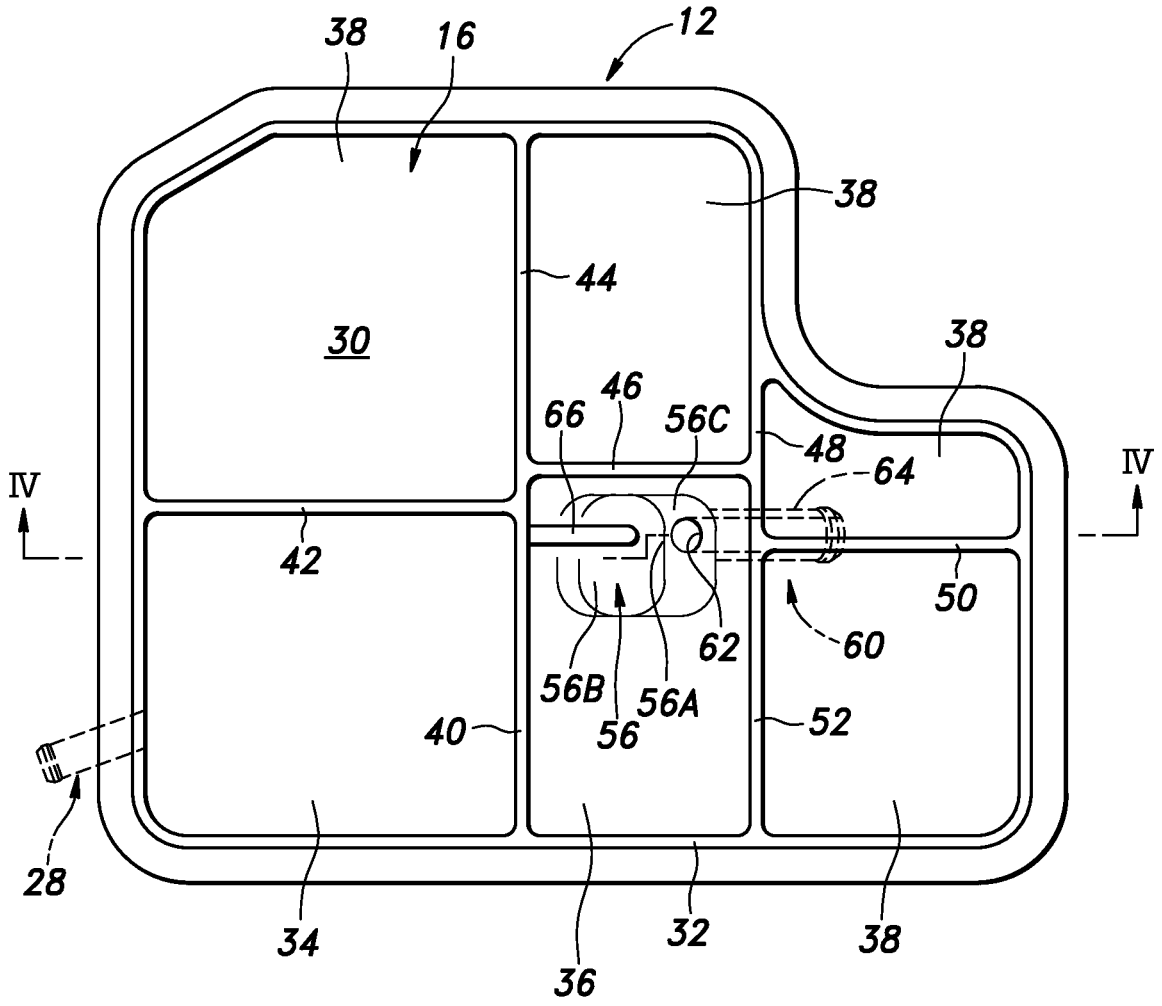
FIG. 2 is a plan view of a lower tank member of the expansion tank of the embodiment.
Figure 3:
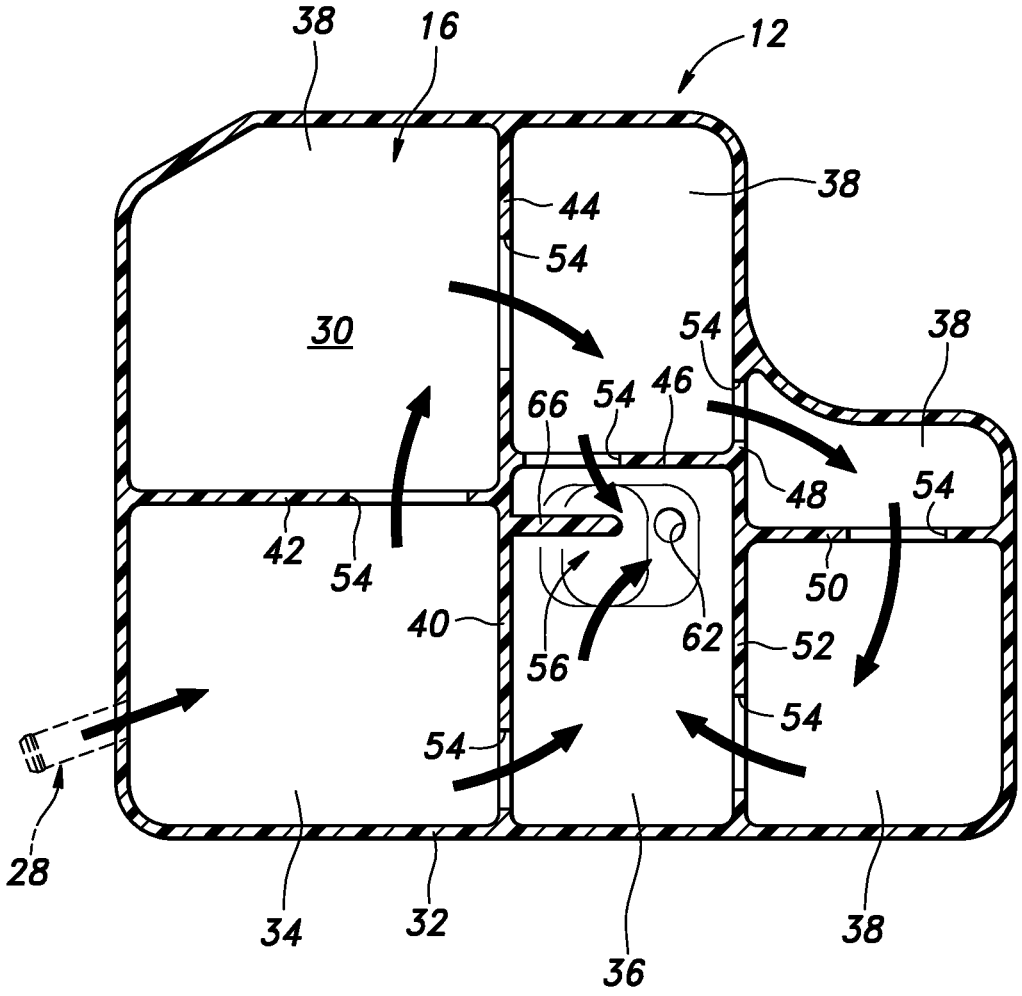
FIG. 3 is a horizontal sectional view of the lower tank member.

As shown in FIG. 2 and FIG. 3, the lower tank member 12 has a bottom wall 30 and a side wall 32 which extends along an outer edge of the bottom wall 30 and stands upright from the outer edge, whereby the lower tank member 12 assumes a box-like shape having an open top.

In the lower tank member 12, multiple partition walls 40, 42, 44, 46, 48, 50, 52 are provided to divide the storage chamber 16 into multiple division chambers 38 including an inlet chamber 34 and an outlet chamber 36. Lower portions of the partition walls 40, 42, 44, 46, 48, 50, 52 are formed with communication holes 54 for bringing adjacent ones of the division chambers 38, such as the inlet chamber 34 and the outlet chamber 36, into communication with each other.

Figure 4:
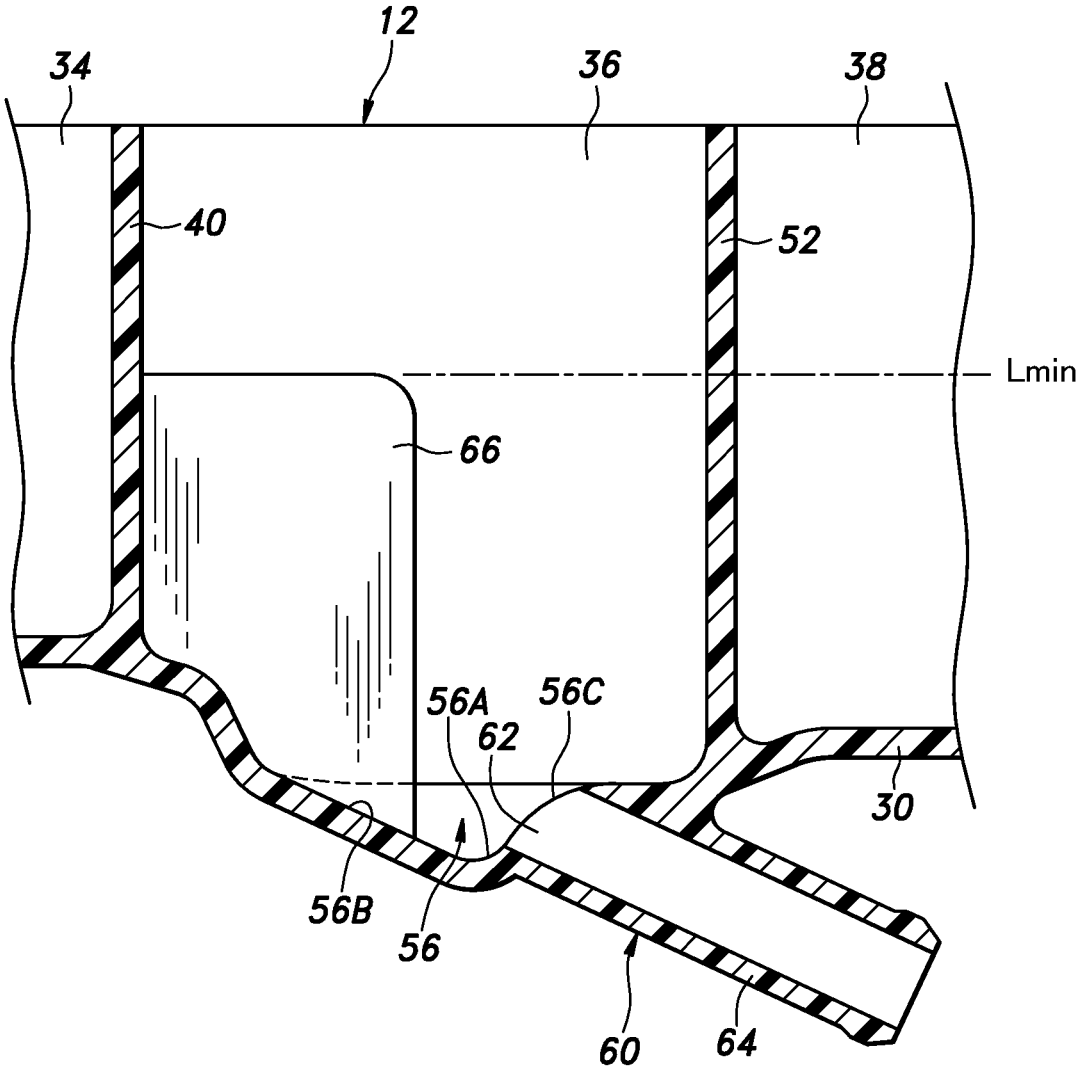
FIG. 4 is an enlarged vertical sectional view (enlarged sectional view taken along line IV-IV in FIG. 2) of a main part of the lower tank member.

A portion of the bottom wall 30 of the lower tank member 12 corresponding to the outlet chamber 36, in other words, a portion of the bottom wall 30 defining the bottom of the outlet chamber 36, is formed with a depression 56. As shown in FIG. 4, the depression 56 includes a gentle slope 56B located on one side of a central part (deepest part) 56A of the depression 56 and slanting downward toward the central part 56A, and a steep slope 56C located on the other side of the central part (deepest part) 56A and slanting downward toward the central part 56A, whereby the depression 56 has a substantially triangular cross-sectional shape.

The bottom of the lower tank member 12 is formed with a coolant liquid outlet portion 60. The coolant liquid outlet portion 60 includes an outlet opening 62 that is open at the steep slope 56C of the depression 56 and a coolant liquid outlet tube 64 extending from the outlet opening 62 to outside of the lower tank member 12 along the slant direction of the gentle slope 56B. Thereby, the coolant liquid outlet portion 60 opens to the outlet chamber 36 in the depression 56.

The lower tank member 12 is formed with a barrier wall 66 provided on a surface of the partition wall 40 facing the outlet chamber 36 and extending into the depression 56 in plan view, as shown in FIGS. 2 and 3. The barrier wall 66 has a flat plate shape vertically extending from a part of the bottom wall 30 of the lower tank member 12 including the gentle slope 56B of the depression 56 to the height corresponding to the lowest liquid level Lmin of the coolant liquid stored in the storage chamber 16 (the outlet chamber 36), as shown in FIG. 4. The barrier wall 66 also extends in a direction crossing the outlet opening 62 as seen in plan view, in other words, in a direction to divide the outlet opening 62 into two.

The depression 56 and the barrier wall 66 are arranged near the communication hole 54 formed in the partition wall 46 to bring the outlet chamber 36 and the division chamber 38 adjacent to the outlet chamber 36 into communication with each other. The communication hole 54 of the partition wall 46 opens toward one surface of the barrier wall 66.

The outlet chamber 36 adjoins the inlet chamber 34 and two division chambers 38 and is in communication with the inlet chamber 34 and the two division chambers 38 via the communication holes 54 formed in the partition walls 40, 46, 52 separating the inlet chamber 34 and the two division chambers 38 from the outlet chamber 36, respectively. The communication hole 54 of the partition wall 46, which opens to the outlet chamber 36, is positioned on the side of the barrier wall 66 opposite from the side on which the communication holes 54 of the partition walls 40 and 52, which also open to the outlet chamber 36, are positioned.

In the expansion tank 10 according to the above-described embodiment, the barrier wall 66 extends to cross a vortex flow (bathtub vortex) of the coolant liquid which, without the barrier wall 66, could be generated substantially about the outlet opening 62 when the coolant liquid stored in the storage chamber 16 flows out of the tank from the outlet chamber 36 through the coolant liquid outlet portion 60. Namely, the barrier wall 66 acts as a baffle to effectively suppress generation of the vortex flow.

Thereby, inflow of air bubbles into the coolant liquid circulation passage (not shown) of the engine cooling system connected to the expansion tank 10 can be effectively suppressed, so that cavitation of a cooling pump (not shown) of the engine cooling system can be suppressed.

Since the barrier wall 66 extends to the height corresponding to the lowest liquid level Lmin of the coolant liquid stored in the outlet chamber 36, the barrier wall 66 can effectively demonstrate the above-described vortex flow suppression effect even if the liquid level of the coolant liquid stored in the outlet chamber 36 becomes the lowest liquid level Lmin.

The communication hole 54 of the partition wall 46 and the communication holes 54 of the partition walls 40 and 52, all of which open to the outlet chamber 36, are positioned on either side of the barrier wall 66, whereby the coolant liquid flowing into the outlet chamber 36 through the communication hole 54 of the partition wall 46 and the coolant liquid flow into the outlet chamber 36 through each of the communication holes 54 of the partition walls 40 and 52 collide with each other in the vicinity of the barrier wall 66. This also contributes to suppressing generation of the vortex flow in the vicinity of the outlet opening 62.

Since the coolant liquid outlet tube 64 of the coolant liquid outlet portion 60 extends from the outlet opening 62 to outside of the lower tank member 12 along the slant direction of the gentle slope 56B of the depression 56, the coolant liquid flowing out of the tank from the depression 56 through the coolant liquid outlet portion 60 can smoothly flow with a low flow resistance. This prevents occurrence of turbulence in the coolant liquid flowing out of the tank, and thereby suppresses mixture of air bubbles into the coolant liquid flowing out of the tank from the coolant liquid outlet portion 60.

Although the present invention has been described in terms of preferred embodiments thereof, it is obvious to those skilled in the art that the present invention is not limited by such embodiments, but can be modified without departing from the spirit of the present invention. For instance, the barrier wall 66 may extend from the side wall 32 of the lower tank member 12 instead of the partition wall such as the partition wall 40. Though the coolant liquid outlet portion 60 slants relative to the bottom of the lower tank member 12 in the illustrated embodiment, the coolant liquid outlet portion 60 may extend vertically downward from the bottom of the lower tank member 12. In the illustrated embodiment, the barrier wall 66 is connected to the bottom wall 30 of the lower tank member 12, but in another embodiment the barrier wall 66 may be spaced from the bottom wall 30. Also, the various components shown in the above embodiments are not necessarily entirely essential, and can be appropriately selected and substituted without departing from the spirit of the present invention.

The invention claimed is:

1. An expansion tank, comprising:

a tank main body defining a storage chamber storing a coolant liquid therein;

multiple partition walls provided in the tank main body to divide the storage chamber into multiple division chambers including an inlet chamber and an outlet chamber, the partition walls being formed with communication holes for bringing adjacent ones of the division chambers into communication with each other;

a coolant liquid inlet portion that is provided on the tank main body and is open to the inlet chamber;

a coolant liquid outlet portion that has an outlet opening in a depression formed in a bottom of the tank main body and is open to the outlet chamber; and a barrier wall extending from a side wall of the tank main body or one of the partition walls into the depression, wherein the communication holes that are open to the outlet chamber include those positioned on either side of the barrier wall.

2. The expansion tank according to claim 1, wherein the barrier wall extends in a direction crossing the outlet opening.

3. The expansion tank according to claim 1, wherein the outlet chamber is in communication with at least two division chambers adjacent thereto via the communication holes formed in the partition walls separating the at least two division chambers from the outlet chamber.

4. The expansion tank according to claim 1, wherein the barrier wall extends to at least a height substantially corresponding to a lowest liquid level of the coolant liquid stored in the storage chamber.

5. An expansion tank, comprising:

a tank main body defining a storage chamber storing a coolant liquid therein;

multiple partition walls provided in the tank main body to divide the storage chamber into multiple division chambers including an inlet chamber and an outlet chamber, the partition walls being formed with communication holes for bringing adjacent ones of the division chambers into communication with each other;

a coolant liquid inlet portion that is provided on the tank main body and is open to the inlet chamber;

a coolant liquid outlet portion that has an outlet opening in a depression formed in a bottom of the tank main body and is open to the outlet chamber; and a barrier wall extending from a side wall of the tank main body or one of the partition walls into the depression, wherein the depression is defined by a portion of a bottom wall of the tank main body slanting downward toward a central part of the depression, and the coolant liquid outlet portion includes a coolant liquid outlet tube extending out from the outlet opening to outside of the tank main body along a slant direction of the portion of the bottom wall.

6. The expansion tank according to claim 5, wherein the barrier wall extends in a direction crossing the outlet opening.

7. The expansion tank according to claim 5, wherein the outlet chamber is in communication with at least two division chambers adjacent thereto via the communication holes formed in the partition walls separating the at least two division chambers from the outlet chamber.

8. The expansion tank according to claim 5, wherein the barrier wall extends to at least a height substantially corresponding to a lowest liquid level of the coolant liquid stored in the storage chamber.

* * * * *